US010842194B2

(12) United States Patent
Batista et al.

(10) Patent No.: US 10,842,194 B2
(45) Date of Patent: Nov. 24, 2020

(54) AEROSOL-GENERATING SYSTEM COMPRISING MULTI-PURPOSE COMPUTING DEVICE

(71) Applicant: Philip Morris Products S.A., Neuchatel (CH)

(72) Inventors: Rui Nuno Batista, Morges (CH); Stephane Antony Hedarchet, Pully (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/500,219

(22) PCT Filed: Aug. 5, 2015

(86) PCT No.: PCT/EP2015/068103

§ 371 (c)(1),
(2) Date: Jan. 30, 2017

(87) PCT Pub. No.: WO2016/023809

PCT Pub. Date: Feb. 18, 2016

(65) Prior Publication Data

US 2017/0273358 A1 Sep. 28, 2017

(30) Foreign Application Priority Data

Aug. 13, 2014 (EP) ..... 14180896

(51) Int. Cl.
*A24F 47/00* (2020.01)

(52) U.S. Cl.
CPC ..... *A24F 47/008* (2013.01)

(58) Field of Classification Search
CPC ..... A24F 47/008
See application file for complete search history.

(56) References Cited

U.S. PATENT DOCUMENTS 5,388,594 A 2/1995 Counts et al.
5,505,214 A 4/1996 Collins et al.
(Continued)

FOREIGN PATENT DOCUMENTS

CN 201733855 U 2/2011
CN 201781983 U 4/2011
(Continued)

OTHER PUBLICATIONS

International Search Report and Written Opinion dated Oct. 29, 2015 in PCT/EP2015/068103 Filed Aug. 5, 2015.
(Continued)

*Primary Examiner* — James Harvey
(74) *Attorney, Agent, or Firm* — Oblon, McClelland, Maier & Neustadt, L.L.P.

(57) ABSTRACT

An electrically operated aerosol-generating system is provided, including an aerosol-generating assembly including an aerosol-forming substrate, at least one electric heater configured to heat the substrate, a first data storage device, a first electrical connector, and a computing device including a supply of electrical energy, a user interface, at least one user input device, a second data storage device, a plurality of software applications installed on the second device, a microprocessor, and a second electrical connector. The first and second electrical connectors are configured to enable two-way data transfer between the computing device and the assembly, and to enable a supply of electrical current from the supply of electrical energy to the heater. At least one of the applications is configured to control the supply of electrical current to the heater in accordance with a predetermined heating profile stored on at least one of the first and second data storage devices.

12 Claims, 4 Drawing Sheets

(56) References Cited

U.S. PATENT DOCUMENTS

| | | | | |
|---|---|---|---|---|
| 5,591,368 | A | 1/1997 | Fleischhauer et al. | |
| 9,872,520 | B1 * | 1/2018 | Elson | A24F 47/008 |
| 10,028,536 | B2 * | 7/2018 | Memari | A24F 15/12 |
| 2009/0320863 | A1 | 12/2009 | Fernando et al. | |
| 2013/0206154 | A1 | 8/2013 | Fernando et al. | |
| 2013/0284192 | A1 | 10/2013 | Peleg et al. | |
| 2013/0340750 | A1 * | 12/2013 | Thorens | A24F 47/008 128/202.21 |
| 2013/0340775 | A1 | 12/2013 | Juster et al. | |
| 2014/0107815 | A1 | 4/2014 | LaMothe | |
| 2014/0123990 | A1 | 5/2014 | Timmermans | |
| 2014/0196732 | A1 | 7/2014 | Liu | |
| 2014/0345633 | A1 | 11/2014 | Talon et al. | |
| 2015/0007838 | A1 | 1/2015 | Fernando et al. | |
| 2015/0101625 | A1 * | 4/2015 | Newton | H05B 1/0244 131/329 |
| 2016/0331035 | A1 * | 11/2016 | Cameron | F01K 5/00 |
| 2016/0345628 | A1 * | 12/2016 | Sabet | A24F 15/18 |
| 2017/0233210 | A1 * | 8/2017 | Kummel | B65H 19/1852 29/432 |
| 2017/0273358 | A1 * | 9/2017 | Batista | A24F 47/008 |
| 2019/0015605 | A1 * | 1/2019 | Palmer | A61M 11/042 |

FOREIGN PATENT DOCUMENTS

| | | | |
|---|---|---|---|
| CN | 102987571 | A | 3/2013 |
| CN | 202958805 | | 6/2013 |
| CN | 103237468 | A | 8/2013 |
| CN | 203689071 | U | 7/2014 |
| EP | 0 857 431 | A1 | 12/1998 |
| EP | 1 736 062 | A2 | 12/2006 |
| EP | 2 110 034 | A1 | 10/2009 |
| EP | 2 706 352 | A1 | 3/2014 |
| JP | 3553599 | B2 | 8/2004 |
| JP | 2011-87569 | A | 5/2011 |
| JP | 2011-517567 | | 6/2011 |
| JP | 2012-90427 | A | 5/2012 |
| JP | 2013-545474 | A | 12/2013 |
| WO | WO 95/01137 | A1 | 1/1995 |
| WO | WO 2007/024130 | A1 | 3/2007 |
| WO | WO 2007/066374 | A1 | 6/2007 |
| WO | WO 2007/131449 | A1 | 11/2007 |
| WO | WO 2007/131450 | A1 | 11/2007 |
| WO | 2013/098398 | A2 | 7/2013 |
| WO | WO 2014/037794 | A2 | 3/2014 |

OTHER PUBLICATIONS

Chinese Office Action with English translation dated Jan. 28, 2019 in corresponding Chinese Patent Application No. 2015800400198.9, (24 pages).

Japanese Office Action with English translation dated Aug. 15, 2019 in corresponding Japanese Patent Application No. 2017-503000, (7 pages).

Combined Chinese Office Action and Search Report dated Nov. 4, 2019, in Patent Application No. 201580040198.9 (with English translation), 20 pages.

Japanese Office Action dated Jan. 9, 2020 in Japanese Patent Application No. 2017-503000 (with English translation), 7 pages.

Japanese Decision to Grant dated Aug. 27, 2020 in corresponding Japanese Patent Application No. 2017-503000 (with English translation), 4 pages.

* cited by examiner

AEROSOL-GENERATING SYSTEM COMPRISING MULTI-PURPOSE COMPUTING DEVICE

TECHNICAL FIELD

The present invention relates to an aerosol-generating system comprising an aerosol-generating assembly and a multi-purpose computing device. The present invention finds particular application as an aerosol-generating system for heating a nicotine-containing aerosol-forming substrate.

DESCRIPTION OF THE RELATED ART

One type of aerosol-generating system is an electrically operated smoking system. Handheld electrically operated smoking systems consisting of an electric heater, an aerosol-generating device comprising a battery and control electronics, and an aerosol-forming cartridge are known.

The primary function of control electronics in known handheld electrically operated smoking systems is controlling the supply of electrical current from the battery to the electric heater during a heating cycle. Typically, any additional functionality provided by the control electronics is basic and autonomous, such as controlling charging of the battery and switching of indicator lights on the device.

It would be desirable to provide increased functionality in an electrically operated smoking system that is both cost effective and convenient for the consumer.

SUMMARY

According to the present invention there is provided an electrically operated aerosol-generating system comprising an aerosol-generating assembly comprising an aerosol-forming substrate, at least one electric heater for heating the aerosol-forming substrate, a first data storage device, and a first electrical connector. The system further comprises a multi-purpose computing device comprising a supply of electrical energy, a multi-purpose user interface, at least one user input device, a second data storage device, a plurality of software applications installed on the second data storage device, a microprocessor, and a second electrical connector. The first and second electrical connectors are configured to enable two-way data transfer between the multi-purpose computing device and the aerosol-generating assembly, and to enable a supply of electrical current from the supply of electrical energy to the at least one electric heater. At least one of the software applications is configured to control a supply of electrical current to the at least one electric heater in accordance with a predetermined heating profile stored on at least one of the first and second data storage devices.

BRIEF DESCRIPTION OF THE DRAWINGS

Embodiments of the invention will now be further described, by way of example only, with reference to the accompanying drawings in which:

FIG. 3 is a perspective view and FIG. 4 is an exploded view of the assembly.

DETAILED DESCRIPTION

Figure 1A:
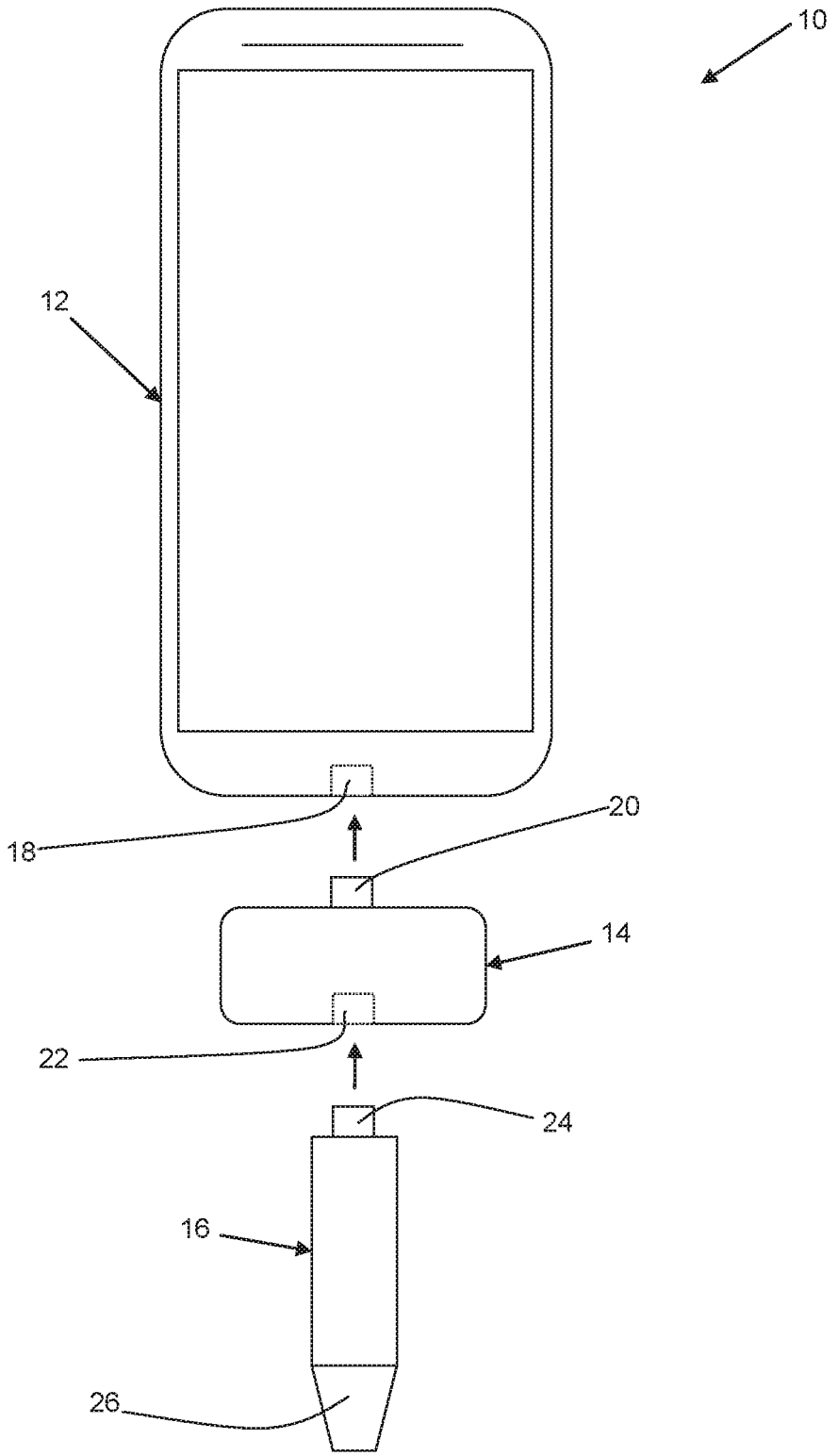
FIGS. 1A and 1B show an electrically operated aerosol-generating system accordance with an embodiment of the present invention.

As used herein, the term "aerosol-generating system" refers to the combination of an aerosol-generating assembly and a multi-purpose computing device, as further described and illustrated herein. In the system, the aerosol-generating assembly and the multi-purpose computing device cooperate to generate an aerosol.

As used herein, the term "aerosol-generating assembly" refers to an assembly comprising at least one electric heater and at least one aerosol-forming substrate that is capable of releasing volatile compounds when heated by the at least one electric heater, wherein the volatile compounds can form an aerosol. For example, an aerosol-generating assembly may be a smoking article that generates an aerosol.

As used herein, the term 'aerosol-forming substrate' is used to describe a substrate capable of releasing volatile compounds, which can form an aerosol. The aerosols generated from aerosol-forming substrates of aerosol-generating assemblies according to the invention may be visible or invisible and may include vapours (for example, fine particles of substances, which are in a gaseous state, that are ordinarily liquid or solid at room temperature) as well as gases and liquid droplets of condensed vapours.

As used herein, the term "multi-purpose computing device" refers to a computing device capable of performing at least one additional function that is not related to the operation of the aerosol-generating assembly. For example, the multi-purpose computing device may be a smartphone that, in addition to comprising at least one software application for controlling the at least one electric heater, can make and receive telephone calls, send and receive text messages and e-mails, provide internet browsing and multimedia playback, and additional software applications not related to the operation of the aerosol-generating assembly.

As used herein, the term "computing device" refers to an electrical device comprising at least one processor that is capable of running one or more software applications.

As used herein, the term "software application" refers to computer-readable instructions that, when run by a processor in a computing device, cause the computing device to operate according to the instructions.

As used herein, the term "multi-purpose user interface" refers to a device that allows a user to interact with the multi-purpose computing device for operations relating to the use of the aerosol-generating assembly and for operations relating to other uses of the device. For example, the user interface may be a device for communicating information to a user, such as an acoustic user interface for conveying an audio signal or a graphical user interface for conveying images, video and data to the user. Examples of information that may be conveyed to a user include data unrelated to the operation of the aerosol-generating assembly, such as e-mails and text messages, internet browsing data, and photographs, in addition to data from the at least one software application configured to control the supply of electrical current to the at least one heater. Suitable user interfaces for communicating information to a user include a speaker, a liquid crystal display (LCD) or an organic light-emitting diode (OLED) display.

As used herein, the term "user input device" refers to a device that allows a user to input data directly into the multi-purpose computing device. For example, the multipurpose user interface could be a touch screen that allows a user to interact with the device by touching the screen. Additionally, or alternatively, the user input device could comprise at least one of a soft key, a hard key, and a microphone.

By providing an aerosol-generating assembly that can be operated using a software application on a multi-purpose computing device, the present invention provides an electrically operated aerosol-generating system that can provide additional functionality when compared to existing aerosol-generating systems, without the need to provide complex and dedicated electronics for controlling the aerosol-generating assembly. In particular, the aerosol-generating assembly and the associated software application can be manufactured and created at relatively low cost and provided to the user for use with an existing multi-purpose computing device.

The supply of electrical energy may be a mains power supply, such as the power supply unit in a personal computer. Alternatively, the supply of electrical energy may comprise a battery, preferably a rechargeable battery.

The first and second connectors may be configured for connection to each other. For example, the first and second connectors may comprise a plug and socket that are configured to connect directly to each other. Additionally, or alternatively, a passive component, such as a cable, may be used to connect the first and second connectors to each other.

Additionally, or alternatively, the electrically operated aerosol-generating system may further comprise a battery unit comprising a battery, a third electrical connector configured for connection to the first electrical connector on the aerosol-generating assembly, and a fourth electrical connector configured for connection to the second electrical connector on the multi-purpose computing device. The first, second, third and fourth electrical connectors are configured to enable the two-way data transfer between the multi-purpose computing device and the aerosol-generating assembly, and the first, second, third and fourth electrical connectors are configured to enable the supply of electrical current from the supply of electrical energy to the aerosol-generating assembly. The first and third electrical contacts are configured to enable a supply of electrical current from the battery to the aerosol-generating assembly. The at least one software application is configured to control the supply of electrical current to the at least one electric heater from at least one of the supply of electrical energy and the battery in accordance with the predetermined heating profile stored on at least one of the first and second data storage devices.

Providing a battery unit can advantageously reduce the draw of current from the multi-purpose computing device when operating the aerosol-generating assembly. In particular, the first and third connectors can be configured so that during operation of the aerosol-generating assembly an electrical current is drawn from the battery in the battery unit for powering the at least one electric heater. This feature is particularly preferred in those embodiments in which the supply of electrical energy within the multi-purpose computing device also comprises a battery and therefore comprises a limited supply of electrical current. In these embodiments, the user can operate the aerosol-generating assembly using the supply of electrical current from the battery in the battery unit while still retaining a sufficient supply of electrical current in the battery in the multi-purpose computing device to allow continued use of the computing device for purposes not related to operation of the aerosol-generating device.

In those embodiments in which the aerosol-generating device can be powered using the battery in a battery unit, the aerosol-generating device may still draw an electrical current from the supply of electrical energy in the multi-purpose computing device during operation of the aerosol-generating device. This may be to provide a further electrical current to the at least one heater element in addition to the electrical current from the battery in the battery unit to increase the thermal output of the at least one heater element. Additionally, or alternatively, the aerosol-generating system may be configured so that the at least one heater element can be powered using only the supply of electrical energy in the multi-purpose computing device. To support this feature, the first, second third and fourth electrical connectors may be configured to transfer electrical energy from the supply of electrical energy in the multi-purpose computing device through the battery unit to the at least one electric heater while bypassing the battery in the battery unit. Additionally, or alternatively, the electrical connectors may be configured so that the first connector can be directly connected to either the third connector on the battery unit or the second connector on the multi-purpose computing device.

In those embodiments comprising a battery unit, the battery may be a disposable battery so that the battery unit must be replaced after a predetermined number of operating cycles. Alternatively, the battery is preferably a rechargeable battery so that the battery unit may be recharged and used. The rechargeable battery may be charged using a separate charging device that may be connected to the third or fourth electrical connector on the battery unit. Additionally, or alternatively, the second and fourth electrical connectors may be configured to enable the transfer of electrical current from the supply of electrical energy in the multi-purpose computing device to the battery in the battery unit to enable charging of the battery in the battery unit.

The at least one software application for controlling the supply of electrical current to the at least one heater may be configured to receive a user input from the at least one user input device. For example, the at least one software application may be configured to receive a user input to enable a user to modify the predetermined heating profile, including at least one of the duration of the heating cycle and the maximum temperature of the heating cycle.

Additionally, or alternatively, the at least one software application may be configured to receive remote data from a remote source and transfer the remote data to the first data storage device. For example, the at least one software application may be configured to receive a new heating profile from the remote source and transfer the new heating profile to the first data storage device. Additionally, or alternatively, the at least one software application may communicate with the remote source to verify that the aerosol-generating assembly is a genuine assembly manufactured specifically for use with the software application. For example, the software application may communicate a serial number stored in the first data storage device in the aerosol-generating assembly to the remote source for comparison with a database of serial numbers. Based on the comparison the remote source can indicate to the software application whether the aerosol-generating assembly is genuine and configured for use with the software application. In the event that the assembly is not genuine or not compatible with the software application the application may communicate an appropriate error message to the user and prevent operation of the aerosol-generating assembly.

In those embodiments in which the at least one application is configured to receive remote data from a remote data source, the remote source may be a remote data server and the at least one software application may be configured to establish a remote data connection with the remote data server to receive the remote data. For example, the multi-purpose computing device may comprise a network adapter for establishing a TCP/IP connection with the remote server for receiving the remote data.

In any of the embodiments described above, the multi-purpose computing device may be configured to receive data from the first data storage device in the aerosol-generating assembly. For example, the multi-purpose computing device may be configured to receive at least one of a heating profile and data identifying the aerosol-generating assembly. Additionally, or alternatively, the multi-purpose computing device may be configured to receive data relating to the operational status of the assembly, such as a list of users or devices that have used the assembly, total puff count, number of puffs remaining, number of heating cycles, or time elapsed since first operation of the assembly.

In any of the embodiments described above, the multi-purpose user interface may comprise a touch-sensitive display, wherein the at least one user input device comprises the touch-sensitive display. For example, the touch-sensitive display may comprise a resistive or a capacitive touch screen.

In any of the embodiments described above, the at least one software application is preferably configured to identify different types of aerosol-generating assembly that may be connected to the multi-purpose computing device. For example, the at least one software application may be configured to receive identification data stored on the first data storage device to determine the type of aerosol-generating assembly. Based upon the identification, the at least one software application may be further configured to query a remote server, as described above, to determine whether any remote data relating to the identified aerosol-generating assembly is available. For example, upon identification of an aerosol-generating assembly, the at least one software application may be configured to query the remote server to determine whether an updated heating profile is available for the identified aerosol-generating assembly.

In any of the embodiments described above, the aerosol-generating assembly may further comprise a main body defining a cavity in which the aerosol-forming substrate, the at least one electric heater and the first data storage device are received. A mouthpiece is provided at a first end of the main body and the first electrical connector is provided at a second end of the main body opposite the first end. Preferably, the first electrical connector and the first data storage device are fixed to the main body. At least one of the mouthpiece, the at least one electric heater and the aerosol-forming substrate may be removable from the main body. For example, the aerosol-forming substrate may be removable from the main body so that it can be replaced with a new aerosol-forming substrate after it has been fully used. Additionally, or alternatively, the at least one heater may be removable from the main body to facilitate cleaning or replacement of the at least one heater. The at least one heater may be removable separately from the aerosol-forming substrate, or the at least one heater and the aerosol-forming substrate may be fixed together so that they are removable from the main body as a single unit. Additionally, or alternatively, the mouthpiece may be removable from the main body to facilitate cleaning or replacement of the mouthpiece. Additionally, or alternatively, in those embodiments in which at least one of the at least one electric heater and the aerosol-forming substrate is removable from the main body, the mouthpiece may be removable from the main body to allow removal of at least one of the at least one electric heater and the aerosol-forming substrate from the cavity.

In use, the user can draw a flow of air through or adjacent to the assembly by sucking on a downstream end of the mouthpiece. In such embodiments, preferably, the assembly is arranged such that the resistance to draw at a downstream end of the mouthpiece is from about 50 mmWG to about 130 mmWG, more preferably from about 80 mmWG to about 120 mmWG, more preferably from about 90 mmWG to about 110 mmWG, most preferably from about 95 mmWG to about 105 mmWG. As used herein, the term "resistance to draw" refers the pressure required to force air through the full length of the object under test at a rate of 17.5 ml/sec at 22° C. and 101 kPa (760 Torr). Resistance to draw is typically expressed in units of millimetres water gauge (mmWG) and is measured in accordance with ISO 6565: 2011.

In any of the embodiments described above, the aerosol-forming substrate may be substantially flat. The aerosol-forming substrate may have any suitable cross-sectional shape. Preferably, the aerosol-forming substrate has a non-circular cross-sectional shape. In certain preferred embodiments, the aerosol-forming substrate has a substantially rectangular cross-sectional shape. In certain embodiments, the aerosol-forming substrate has an elongate, substantially rectangular, parallelepiped shape.

As used herein, the term "substantially flat" refers to a component having a thickness to width ratio of at least about 1:2. Preferably, the thickness to width ratio is less than about 1:20 to minimise the risk of bending or breaking the component.

Flat components can be easily handled during manufacture. In addition, it has been found that aerosol release from the aerosol-forming substrate is improved when it is substantially flat and when arranged so that a flow of air is drawn across the width, length, or both, of the aerosol-forming substrate.

In any of the embodiments described above, the aerosol-forming substrate may comprise nicotine. For example, the aerosol-forming substrate may comprise a tobacco-containing material with volatile tobacco flavour compounds which are released from the aerosol-forming substrate upon heating.

Preferably, the aerosol-forming substrate comprises an aerosol former, that is, a substance which generates an aerosol upon heating. The aerosol former may be, for instance, a polyol aerosol former or a non-polyol aerosol former. It may be a solid or liquid at room temperature, but preferably is a liquid at room temperature. Suitable polyols include sorbitol, glycerol, and glycols like propylene glycol or triethylene glycol. Suitable non-polyols include monohydric alcohols, such as menthol, high boiling point hydrocarbons, acids such as lactic acid, and esters such as diacetin, triacetin, triethyl citrate or isopropyl myristate. Aliphatic carboxylic acid esters such as methyl stearate, dimethyl dodecanedioate and dimethyl tetradecanedioate can also be used as aerosol formers. A combination of aerosol formers may be used, in equal or differing proportions. Polyethylene glycol and glycerol may be particularly preferred, whilst triacetin is more difficult to stabilise and may also need to be encapsulated in order to prevent its migration within the product. The aerosol-forming substrate may include one or more flavouring agents, such as cocoa, liquorice, organic acids, or menthol.

The aerosol-forming substrate may comprise a solid substrate. The solid substrate may comprise, for example, one or more of: powder, granules, pellets, shreds, spaghettis, strips or sheets containing one or more of: herb leaf, tobacco leaf, fragments of tobacco ribs, reconstituted tobacco, homogenised tobacco, extruded tobacco and expanded tobacco. Optionally, the solid substrate may contain additional tobacco or non-tobacco volatile flavour compounds, to be released upon heating of the substrate. Optionally, the solid substrate may also contain capsules that, for example, include the additional tobacco or non-tobacco volatile flavour compounds. Such capsules may melt during heating of the solid aerosol-forming substrate. Alternatively, or in addition, such capsules may be crushed prior to, during, or after heating of the solid aerosol-forming substrate.

Where the aerosol-forming substrate comprises a solid substrate comprising homogenised tobacco material, the homogenised tobacco material may be formed by agglomerating particulate tobacco. The homogenised tobacco material may be in the form of a sheet. The homogenised tobacco material may have an aerosol-former content of greater than 5 percent on a dry weight basis. The homogenised tobacco material may alternatively have an aerosol former content of between 5 percent and 30 percent by weight on a dry weight basis. Sheets of homogenised tobacco material may be formed by agglomerating particulate tobacco obtained by grinding or otherwise comminuting one or both of tobacco leaf lamina and tobacco leaf stems; alternatively, or in addition, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof. Sheets of homogenised tobacco material are preferably formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

Optionally, the solid substrate may be provided on or embedded in a thermally stable carrier. The carrier may take the form of powder, granules, pellets, shreds, spaghettis, strips or sheets. Alternatively, the carrier may be a tubular carrier having a thin layer of the solid substrate deposited on its inner surface, such as those disclosed in U.S. Pat. Nos. 5,505,214, 5,591,368 and 5,388,594, or on its outer surface, or on both its inner and outer surfaces. Such a tubular carrier may be formed of, for example, a paper, or paper like material, a non-woven carbon fibre mat, a low mass open mesh metallic screen, or a perforated metallic foil or any other thermally stable polymer matrix. The solid substrate may be deposited on the surface of the carrier in the form of, for example, a sheet, foam, gel or slurry. The solid substrate may be deposited on the entire surface of the carrier, or alternatively, may be deposited in a pattern in order to provide a predetermined or non-uniform flavour delivery during use. Alternatively, the carrier may be a non-woven fabric or fibre bundle into which tobacco components have been incorporated, such as that described in EP-A-0 857 431. The non-woven fabric or fibre bundle may comprise, for example, carbon fibres, natural cellulose fibres, or cellulose derivative fibres.

As an alternative to a solid tobacco-based aerosol-forming substrate, the aerosol-forming substrate may comprise a liquid substrate and the assembly may comprise means for retaining the liquid substrate, such as one or more containers. Alternatively or in addition, the assembly may comprise a porous carrier material, into which the liquid substrate is absorbed, as described in WO-A-2007/024130, WO-A-2007/066374, EP-A-1 736 062, WO-A-2007/131449 and WO-A-2007/131450.

The liquid substrate is preferably a nicotine source comprising one or more of nicotine, nicotine base, a nicotine salt, such as nicotine-HCl, nicotine-bitartrate, or nicotine-ditartrate, or a nicotine derivative.

The nicotine source may comprise natural nicotine or synthetic nicotine.

The nicotine source may comprise pure nicotine, a solution of nicotine in an aqueous or non-aqueous solvent or a liquid tobacco extract.

The nicotine source may further comprise an electrolyte forming compound. The electrolyte forming compound may be selected from the group consisting of alkali metal hydroxides, alkali metal oxides, alkali metal salts, alkaline earth metal oxides, alkaline earth metal hydroxides and combinations thereof.

For example, the nicotine source may comprise an electrolyte forming compound selected from the group consisting of potassium hydroxide, sodium hydroxide, lithium oxide, barium oxide, potassium chloride, sodium chloride, sodium carbonate, sodium citrate, ammonium sulfate and combinations thereof.

In certain embodiments, the nicotine source may comprise an aqueous solution of nicotine, nicotine base, a nicotine salt or a nicotine derivative and an electrolyte forming compound.

Alternatively or in addition, the nicotine source may further comprise other components including, but not limited to, natural flavours, artificial flavours and antioxidants.

In addition to a nicotine-containing aerosol-forming substrate, the aerosol-forming substrate may further comprise a source of a volatile delivery enhancing compound that reacts with the nicotine in the gas phase to aid delivery of the nicotine to the user.

The volatile delivery enhancing compound may comprise a single compound. Alternatively, the volatile delivery enhancing compound may comprise two or more different compounds.

Preferably, the volatile delivery enhancing compound is a volatile liquid.

The volatile delivery enhancing compound may comprise an aqueous solution of one or more compounds. Alternatively the volatile delivery enhancing compound may comprise a non-aqueous solution of one or more compounds.

The volatile delivery enhancing compound may comprise two or more different volatile compounds. For example, the volatile delivery enhancing compound may comprise a mixture of two or more different volatile liquid compounds.

Alternatively, the volatile delivery enhancing compound may comprise one or more non-volatile compounds and one or more volatile compounds. For example, the volatile delivery enhancing compound may comprise a solution of one or more non-volatile compounds in a volatile solvent or a mixture of one or more non-volatile liquid compounds and one or more volatile liquid compounds.

In one embodiment, the volatile delivery enhancing compound comprises an acid. The volatile delivery enhancing compound may comprise an organic acid or an inorganic acid. Preferably, the volatile delivery enhancing compound comprises an organic acid, more preferably a carboxylic acid, most preferably an alpha-keto or 2-oxo acid.

In a preferred embodiment, the volatile delivery enhancing compound comprises an acid selected from the group consisting of 3-methyl-2-oxopentanoic acid, pyruvic acid, 2-oxopentanoic acid, 4-methyl-2-oxopentanoic acid, 3-methyl-2-oxobutanoic acid, 2-oxooctanoic acid and combinations thereof. In a particularly preferred embodiment, the volatile delivery enhancing compound comprises pyruvic acid.

As an alternative to a solid or liquid aerosol-forming substrate, the aerosol-forming substrate may be any other sort of substrate, for example, a gas substrate, a gel substrate, or any combination of the various types of substrate described.

In any of the embodiments described above, the aerosol-forming substrate may comprise a single aerosol-forming substrate. Alternatively, the aerosol-forming substrate may comprise a plurality of aerosol-forming substrates. The plurality of aerosol-forming substrates may have the substantially the same composition. Alternatively, the plurality of aerosol-forming substrates may comprise two or more aerosol-forming substrates having substantially different compositions. The plurality of aerosol-forming substrates may be stored together on the base layer. Alternatively, the plurality of aerosol-forming substrates may be stored separately. By separately storing two or more different portions of aerosol-forming substrate, it is possible to store two substances which are not entirely compatible in the same assembly. Advantageously, separately storing two or more different portions of aerosol-forming substrate may extend the life of the assembly. It also enables two incompatible substances to be stored in the same assembly. Further, it enables the aerosol-forming substrates to be aerosolised separately, for example by heating each aerosol-forming substrate separately. Thus, aerosol-forming substrates with different heating profile requirements can be heated differently for improved aerosol formation. It may also enable more efficient energy use, since more volatile substances can be separately from less volatile substances and to a lesser degree. Separate aerosol-forming substrates can also be aerosolised in a predefined sequence, for example by heating a different one of the plurality of aerosol-forming substrates for each use, ensuring a 'fresh' aerosol-forming substrate is aerosolised each time the assembly is used. In those embodiments comprising a liquid nicotine aerosol-forming substrate and a volatile delivery enhancing compound aerosol-forming substrate, the nicotine and the volatile delivery enhancing compound are advantageously stored separately and reacted together in the gas phase only when the system is in operation.

In certain preferred embodiments, the aerosol-forming substrate has a vaporisation temperature of from about 60 degrees Celsius to about 320 degrees Celsius, preferably from about 70 degrees Celsius to about 230 degrees Celsius, preferably from about 90 degrees Celsius to about 180 degrees Celsius.

Each of the first, second, third and fourth electrical connectors may have any suitable form. Each of the electrical connectors may comprise a plurality of substantially flat electrical contacts. Advantageously, substantially flat electrical contacts have been found to be more reliable for establishing an electrical connection and are easier to manufacture. Preferably, the electrical contacts comprise part of a standardised electrical connection, including, but not limited to, USB-A, USB-B, USB-C, USB-mini, USB-micro, SD, miniSD, or microSD type connections. As used herein, the term "standardised electrical connection" refers an electrical connection which is specified by an industrial standard. Alternatively, the electrical contact may comprise part of a proprietary electrical connection that complies with a standard set by one or more manufacturers but is not specified by an industrial standard. For example, some smartphones utilise a proprietary connection to provide data transfer and recharging functions.

In any of the embodiments described above, the multipurpose computing device may comprise one of a personal computer, a laptop, a netbook, a tablet computer, a smartphone, or a smartwatch. To facilitate use of the aerosol-generating assembly when connected directly to the multipurpose computing device the device is preferably a smartphone.

In any of the embodiments described above, the aerosol-generating assembly may comprise an air flow channel extending between at least one air inlet and at least one air outlet, wherein the air flow channel is in fluid communication with the aerosol-forming substrate. The air flow channel has an internal wall surface on which one or more flow disturbing devices are disposed, the flow disturbing devices being arranged to create a turbulent boundary layer in a flow of air drawn through the air flow channel.

By providing an air flow channel having one or more flow disturbing devices on an internal wall surface to create a turbulent boundary layer in a flow of air drawn through the air flow channel, the aerosol-generating assembly can provide a resistance to draw that is relatively consistent, regardless of the level of draw on the system. This is in contrast to prior art systems, in which an increase in draw can cause a sudden change in the resistance to draw. It is thought that the sudden change in resistance to draw in prior art systems results from the separation of a laminar boundary layer of air flow from a wall of the air flow channel as the level of draw increases above a certain level. However, in aerosol-generating assemblies comprising one or more flow disturbing devices, the turbulent boundary layer caused by the one or more flow disturbing devices mitigates this effect.

In some embodiments, the flow disturbing devices comprise one or more dimples or undulations on the internal wall surface. Advantageously, one or more dimples and undulations are particularly effective for providing the required turbulent boundary layer in the air flow channel. Furthermore, dimples and undulations are relatively simple to form in materials typically used to construct components for aerosol-generating assemblies. For example, dimples and undulations can be formed by moulding, stamping, embossing, debossing, and combinations thereof. Depressions in the internal wall surface formed by dimples or undulations can also create areas of reduced air pressure within the airflow channel. This is particularly advantageous in embodiments in which the one or more dimples or undulations are provided on at least a portion of the internal wall surface opposite the at least one aerosol-forming substrate, as the regions of reduced air pressure can facilitate migration of volatile compounds from the aerosol-forming substrate into the air flow.

In those embodiments in which the flow disturbing devices comprise one or more dimples or undulations, the dimples or undulations preferably have a number average maximum depth of from about 0.3 millimetres to about 0.8 millimetres. Additionally, or alternatively, the one or more dimples or undulations preferably have a number average maximum depth of from about 15 percent to about 80 percent of the thickness of the air flow channel, more preferably from about 30 percent to about 50 percent of the thickness of the air flow channel. One or more dimples or undulations having dimensions within one or both of these ranges have been found to be particularly effective at providing a turbulent boundary layer flow.

As used herein, the term "number average maximum depth" refers to the average depth of the dimples or undulations, wherein the depth of each dimple or undulation is measured at its maximum depth.

The flow disturbing devices preferably comprise a plurality of dimples on the internal wall surface. Preferably, the dimples have a number average maximum diameter of from about 3 millimetres to about 6 millimetres, more preferably from about 3 millimetres to about 5 millimetres, most preferably from about 3 millimetres to about 4 millimetres. Increasing the dimple size above 6 millimetres can reduce the effectiveness of the dimples in creating the desired turbulent boundary layer flow.

As used herein, the term "number average maximum diameter" refers to the average diameter of the dimples, wherein the diameter of each dimple is measured at its maximum diameter.

The air flow channel preferably comprises a diffuser section in which a flow area of the channel is increased in the downstream direction from the air inlet to the air outlet. Preferably, the at least one aerosol-generating substrate is provided at least partly in the diffuser section of the airflow channel. Providing a diffuser section advantageously reduces the velocity of the airflow as it enters the diffuser section and facilitates the formation of aerosol droplets of a larger size. However, preferably, the maximum cross-sectional area of the diffuser section is not too large compared to the cross-sectional area of the air flow inlet, otherwise the air flow velocity can be reduced to a level at which the aerosol droplets begin to condense on the inside of the air flow channel. Therefore, the maximum cross-sectional area of the air inlet is preferably between about 1 percent and about 40 percent of the maximum cross-sectional area of the diffuser section, more preferably between about 5 percent and about 20 percent of the maximum cross-sectional area of the diffuser section. In those embodiments in which the air inlet comprises a plurality of apertures, the area of the air inlet is the combined area of the plurality of apertures.

As used herein, the term "flow area" refers to the cross-sectional area of the air flow channel in a plane that is perpendicular to the general direction of the air flow through the channel.

The aerosol-generating assembly may comprise a base layer and the at least one aerosol-forming substrate provided on the base layer. Preferably, the base layer and the at least one aerosol-forming substrate are substantially flat and are arranged substantially parallel to each other.

The aerosol-generating assembly may further comprise a top cover overlying the at least one aerosol-forming substrate and secured to the base layer. In such embodiments, the air flow channel is at least partially defined between the top cover and the base layer so that the at least one aerosol-generating substrate is in fluid communication with the air flow channel.

In embodiments comprising a top cover, the internal wall surface on which the one or more flow disturbing devices are disposed is preferably at least partially formed by the top cover. This construction can simplify the manufacture of the system, as the one or more flow devices can be formed on one or both of the top cover and the base layer before the top cover and the base layer are secured together to create the airflow channel. In other words, the air flow channel can be manufactured in two parts, which facilitates the formation of features on the internal wall surface of the air flow channel. This method of construction is particularly advantageous in embodiments in which the air flow channel comprises a variable cross-section, such as those embodiments in which the air flow channel comprises a diffuser section.

In any of the embodiments described above, the flow disturbing devices preferably occupy from about 30% to about 100% of the internal wall surface area. Providing flow disturbing devices over an area of the internal wall surface within this range can provide sufficient turbulence in the boundary layer flow to optimise the stability of the resistance to draw through the system.

In any of the embodiments described above, and particularly those in which the aerosol-generating assembly comprises a substantially flat base layer and a substantially flat aerosol-generating substrate, the air flow channel preferably has a substantially oblong cross-sectional shape along at least part of its length.

As used herein, the term "substantially oblong" refers to a substantially rectangular shape having a length greater than its width. That is, an oblong is a non-square rectangle.

To maximise the surface area over which the flow disturbing devices are provided, the flow disturbing devices are preferably provided on one or both of the long sides of the substantially oblong shape. Additionally, the flow disturbing devices may be provided on one or both of the short sides of the substantially oblong shape.

Additionally, or alternatively, in those embodiments comprising a diffuser section, preferably the height of the air flow channel remains constant and the width of the airflow channel increases in the downstream direction in the diffuser section. That is, the length of the short sides of the substantially oblong shape preferably remains constant and the length of the long sides of the substantially oblong shape preferably increases in the downstream direction in the diffuser section.

The aerosol-generating assembly may comprise a protective foil positioned over at least part of the at least one aerosol-forming substrate. The protective foil may be gas impermeable. The protective foil may be arranged to hermetically seal the aerosol-forming substrate within the assembly. As used herein, the term "hermetically seal" means that the weight of the volatile compounds in the aerosol-forming substrate changes by less than 2% over a two week period, preferably over a two month period, more preferably over a two year period.

In those embodiments in which the assembly comprises a base layer, the base layer may comprise at least one cavity in which the aerosol-forming substrate is held. In these embodiments, the protective foil may be arranged to close the one or more cavities. The protective foil may be at least partially removable to expose the at least one aerosol-forming substrate. Preferably, the protective foil is removable. Where the base layer comprises a plurality of cavities in which a plurality of aerosol-forming substrates are held, the protective foil may be removable in stages to selectively unseal one or more of the aerosol-forming substrates. For example, the protective foil may comprise one or more removable sections, each of which is arranged to reveal one or more of the cavities when removed from the remainder of the protective foil. Alternatively, or in addition, the protective foil may be attached such that the required removal force varies between the various stages of removal as an indication to the user. For example, the required removal force may increase between adjacent stages so that the user must deliberately pull harder on the protective foil to continue removing the protective foil. This may be achieved by any suitable means. For example, the pulling force may be varied by altering the type, quantity, or shape of an adhesive layer, or by altering the shape or amount of a weld line by which the protective foil is attached.

The protective foil may be removably attached to the base layer either directly or indirectly via one or more intermediate components. The protective foil may be removably attached by any suitable method, for example using adhesive. The protective foil may be removably attached by ultrasonic welding. The protective foil may be removably attached by ultrasonic welding along a weld line. The weld line may be continuous. The weld line may comprise two or more continuous weld lines arranged side by side. With this arrangement, the seal can be maintained provided at least one of the continuous weld lines remains intact.

The protective foil may be a flexible film. The protective foil may comprise any suitable material or materials. For example, the protective foil may comprise a polymeric foil, for example Polypropylene (PP) or Polyethylene (PE). The protective foil may comprise a multilayer polymeric foil.

In any of the embodiments described above, the at least one electric heater may comprise one or more electric heaters fixed within the aerosol-generating assembly. Alternatively, the at least one electric heater may be a removable heater that can be inserted into and removed from the aerosol-generating assembly to facilitate cleaning and replacement of the heater. Furthermore, using a removable heater that is separate from aerosol-generating assembly allows the heater to be used to heat multiple assemblies.

In any of the embodiments described above, the heater may comprise an electrically insulating substrate, wherein the at least one electric heater element comprises one or more substantially flat heater elements arranged on the electrically insulating substrate. The substrate may be flexible. The substrate may be polymeric. The substrate may be a multi-layer polymeric material. The heating element, or heating elements, may extend across one or more apertures in the substrate.

In use, the heater may be arranged to heat the aerosol-forming substrate by one or more of conduction, convection and radiation. The heater may heat the aerosol-forming substrate by means of conduction and may be at least partially in contact with the aerosol-forming substrate. Alternatively, or in addition, the heat from the heater may be conducted to the aerosol-forming substrate by means of an intermediate heat conductive element. Alternatively, or in addition, the heater may transfer heat to the incoming ambient air that is drawn through or past the cartridge during use, which in turn heats the aerosol-forming substrate by convection.

The heater may comprise an internal electric heating element for at least partially inserting into the aerosol-forming substrate. An "internal heating element" is one which is suitable for insertion into an aerosol-forming material. Alternatively or additionally, the electric heater may comprise an external heating element. The term "external heating element" refers to one that at least partially surrounds the aerosol-forming substrate. The heater may comprise one or more internal heating elements and one or more external heating elements. The heater may comprise a single heating element. Alternatively, the heater may comprise more than one heating element.

The at least one heating element may comprise an electrically resistive material. Suitable electrically resistive materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group. Examples of suitable metal alloys include stainless steel, nickel-, cobalt-, chromium-, aluminium-titanium-zirconium-, hafnium-, niobium-, molybdenum-, tantalum-, tungsten-, tin-, gallium-, manganese- and iron-containing alloys, and super-alloys based on nickel, iron, cobalt, stainless steel, Timetal® and iron-manganese-aluminium based alloys. In composite materials, the electrically resistive material may optionally be embedded in, encapsulated or coated with an insulating material or vice-versa, depending on the kinetics of energy transfer and the external physicochemical properties required. Alternatively, the heater may comprise an infra-red heating element, a photonic source, or an inductive heating element.

The heater may take any suitable form. For example, the heater may take the form of a heating blade. Alternatively, the heater may take the form of a casing or substrate having different electro-conductive portions, or an electrically resistive metallic tube. Alternatively, the heater may comprise one or more heating needles or rods that run through the centre of the aerosol-forming substrate. Alternatively, the heater may be a disk (end) heater or a combination of a disk heater with heating needles or rods. The heater may comprise one or more stamped portions of electrically resistive material, such as stainless steel. Other alternatives include a heating wire or filament, for example a Ni—Cr (Nickel-Chromium), platinum, tungsten or alloy wire or a heating plate.

In certain preferred embodiments, the heater comprises a plurality of electrically conductive filaments. The plurality of electrically conductive filaments may form a mesh or array of filaments or may comprise a woven or non-woven fabric.

The electrically conductive filaments may define interstices between the filaments and the interstices may have a width of between 10 μm and 100 μm. Preferably the filaments give rise to capillary action in the interstices, so that when the heater is placed in contact with a liquid-containing aerosol-forming substrate, liquid to be vapourised is drawn into the interstices, increasing the contact area between the heater assembly and the liquid. The electrically conductive filaments may form a mesh of size between 160 and 600 Mesh US (+/−10 percent) (i.e. between 160 and 600 filaments per inch (+/−10 percent). The width of the interstices is preferably between 25 μm and 75 μm. The percentage of open area of the mesh, which is the ratio of the area of the interstices to the total area of the mesh, is preferably between 25 percent and 56 percent. The mesh may be formed using different types of weave or lattice structures. The mesh, array or fabric of electrically conductive filaments may also be characterised by its ability to retain liquid, as is well understood in the art. The electrically conductive filaments may have a diameter of between 10 μm and 100 μm, preferably between 8 μm and 50 μm, and more preferably between 8 μm and 39 μm. The filaments may have a round cross section or may have a flattened cross-section. The heater filaments may be formed by etching a sheet material, such as a foil. This may be particularly advantageous when the heater comprises an array of parallel filaments. If the heater comprises a mesh or fabric of filaments, the filaments may be individually formed and knitted together. The electrically conductive filaments may be provided as a mesh, array or fabric. The area of the mesh, array or fabric of electrically conductive filaments may be small, preferably less than or equal to 25 square millimetres, allowing it to be incorporated in to a handheld system. The mesh, array or fabric of electrically conductive filaments may, for example, be rectangular and have dimensions of 5 mm by 2 mm. Preferably, the mesh or array of electrically conductive filaments covers an area of between 10 percent and 50 percent of the area of the heater. More preferably, the mesh or array of electrically conductive filaments covers an area of between 15 percent and 25 percent of the area of the heater.

In one embodiment, electrical current is supplied to the electric heater until the heating element or elements of the electric heater reach a temperature of between approximately 180 degrees Celsius and about 310 degrees Celsius. Any suitable temperature sensor in combination with the at least one software application may be used in order to control heating of the heating element or elements to reach the required temperature. This is in contrast to conventional cigarettes in which the combustion of tobacco and cigarette wrapper may reach 800 degrees Celsius.

Preferably, the minimum distance between the electric heater and the at least one aerosol-forming substrate is less than 50 micrometres, preferably the assembly comprises one or more layers of capillary fibres in the space between the electric heater and the aerosol-forming substrate.

The heater may comprise one or more heating elements above the aerosol-forming substrate. Alternatively, the heater may comprise one or more heating elements below the aerosol-forming substrate. With this arrangement, heating of the aerosol-forming substrate and aerosol release occur on opposite sides of the aerosol-generating assembly. This has been found to be particularly effective for aerosol-forming substrates which comprise a tobacco-containing material. In certain embodiments, the heater comprises one or more heating elements positioned adjacent to opposite sides of the aerosol-forming substrate. Preferably the heater comprises a plurality of heating elements arranged to heat a different portion of the aerosol-forming substrate. In certain preferred embodiments, the aerosol-forming substrate comprises a plurality of aerosol-forming substrates arranged separately on a base layer and the heater comprises a plurality of heating elements each arranged to heat a different one of the plurality of aerosol-forming substrates.

The aerosol-generating assembly may have any suitable size. In certain embodiments, the assembly has length of from about 5 mm to about 200 mm, preferably from about 10 mm to about 100 mm, more preferably from about 20 mm to about 35 mm. In certain embodiments, the assembly has width of from about 5 mm to about 12 mm, preferably from about 7 mm to about 10 mm. In certain embodiments, the assembly has a height of from about 2 mm to about 10 mm, preferably from about 5 mm to about 8 mm.

In accordance with a further aspect, the present invention provides an aerosol-generating assembly comprising a main body housing an aerosol-forming substrate, at least one electric heater for heating the aerosol-forming substrate, and control electronics. The assembly further comprises a first electrical connector connected to the control electronics. The main body is shaped for connection to a smartphone to enable the exchange of data through a direct connection of the first electrical connector of the aerosol-generating assembly with a corresponding second electrical connector on the smartphone.

Preferably, the first electrical connector is provided on a first side of the main body and the second electrical connector is provided on a first side of the smartphone, wherein when the main body is connected to the smartphone the first side of the main body is in contact with the first side of the smartphone. Preferably, the dimensions of the first side of the main body are substantially the same as the dimensions of the first side of the smartphone.

Additionally, or alternatively, a software application hosted on the smartphone may trigger upgrades of at least part of a data or software stored within the aerosol-generating assembly. Additionally, or alternatively, the software application may control some parameters of the aerosol-generating assembly, particularly the heating profile for the assembly.

Additionally, or alternatively, the aerosol-forming substrate may comprise at least one of a heated tobacco product and a nicotine-containing product.

FIG. 1A shows an electrically operated aerosol-generating system 10 in accordance with an embodiment of the present invention. The system 10 comprises a multi-purpose computing device 12 in the form of a smartphone, a battery unit 14 and an aerosol-generating assembly 16. The smartphone comprises a micro-USB port 18 for receiving a standard micro-USB charger and data cable. The battery unit 14 comprises a micro-USB plug 20 on one side of the battery unit 14 and a micro-USB port 22 on the opposite side of the battery unit 14. The aerosol-generating assembly 16 comprises a micro-USB plug 24 at one end of the assembly 16 and a mouthpiece 26 at the opposite end of the assembly 16. In use, the micro-USB plug 24 on the assembly 16 can be plugged directly into the micro-USB port 18 on the smartphone, as shown, for example, in FIG. 1B. Alternatively, the micro-USB plug 20 on the battery unit 14 can be plugged into the micro-USB port 18 on the smartphone and the micro-USB plug 24 on the assembly 16 can be plugged into the micro-USB port 22 on the battery unit 14, as shown, for example, in FIG. 1A.

Figure 1B:
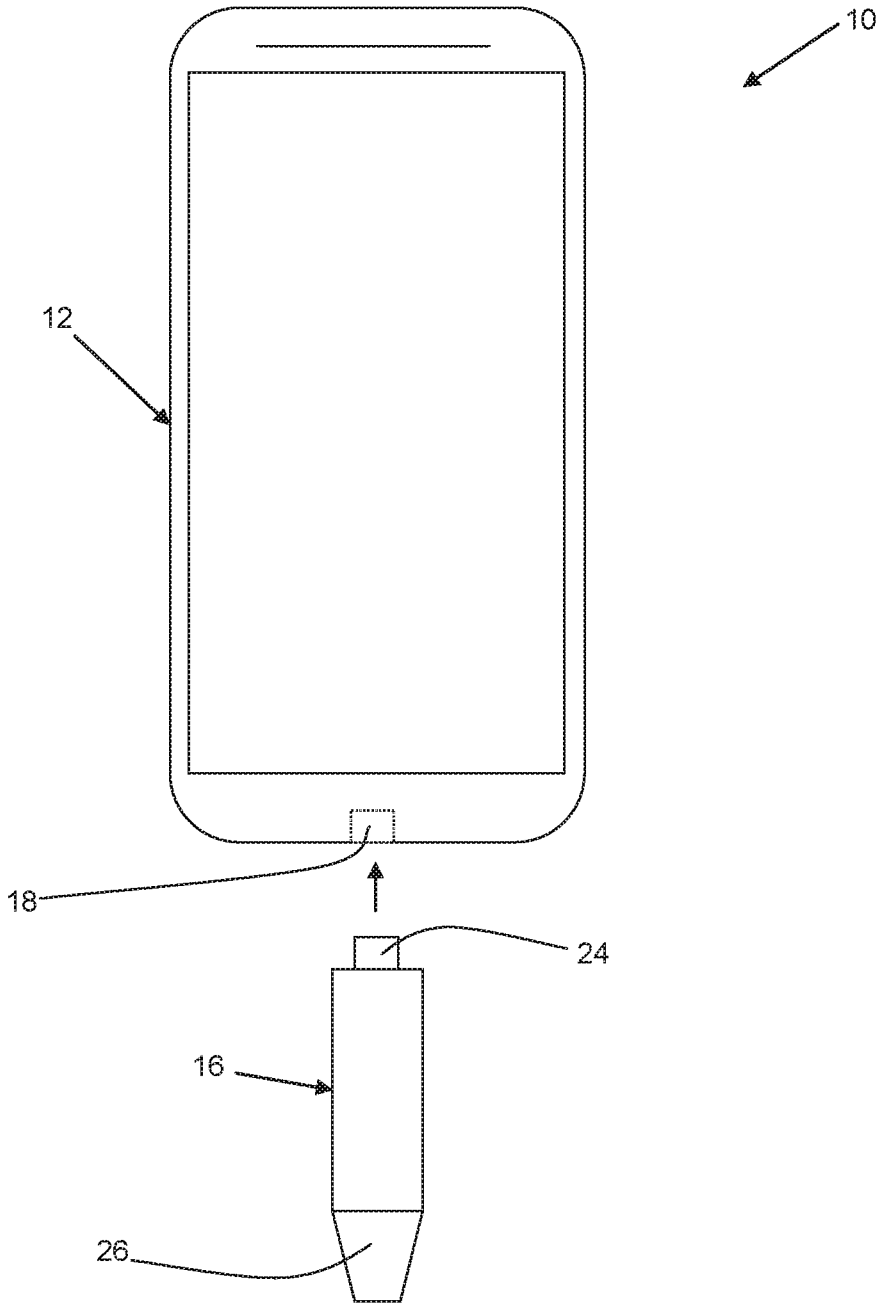
Figure 2:
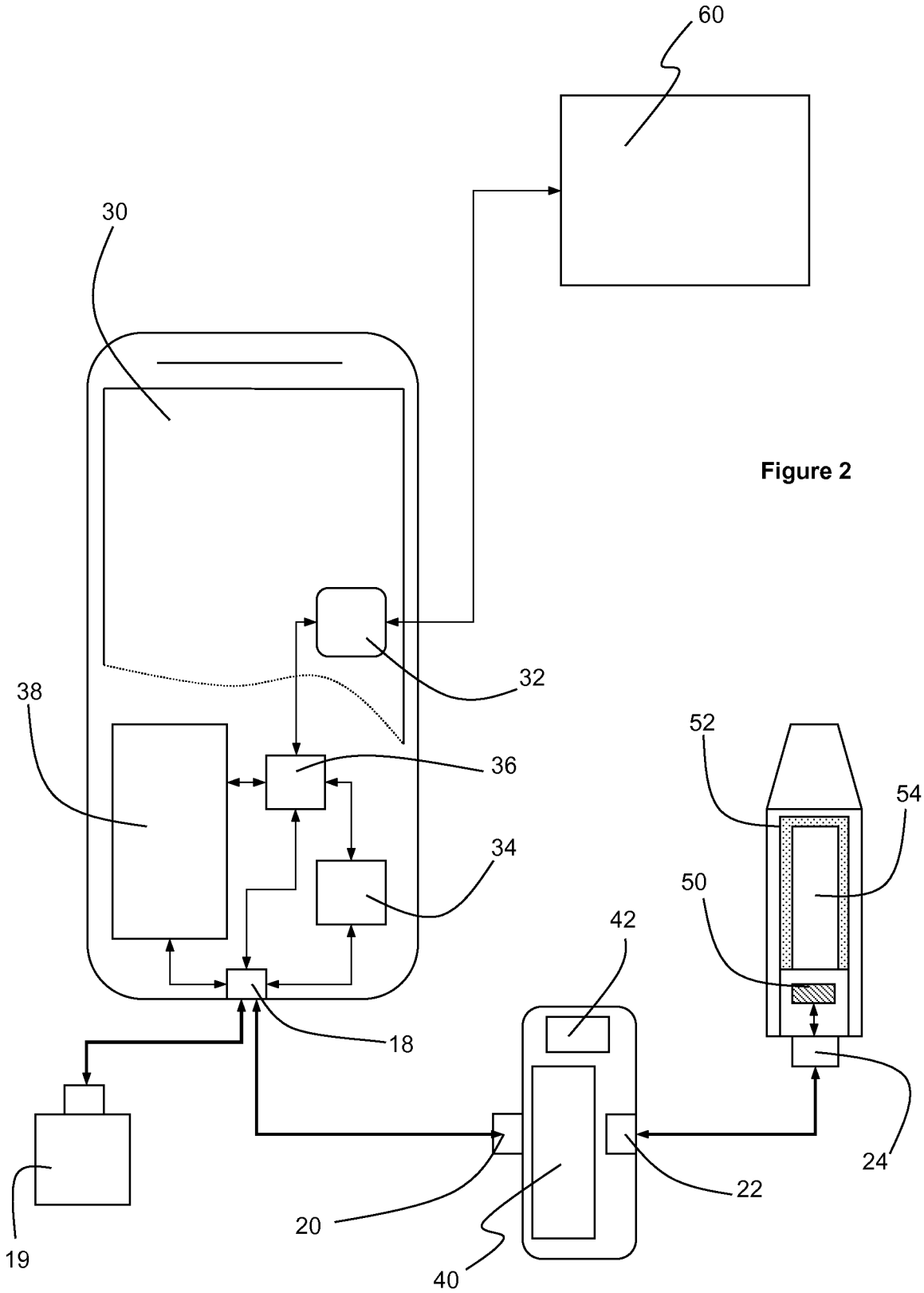
FIG. 2 shows a schematic representation of the electrically operated aerosol-generating system of FIGS. 1A and 1B.

FIG. 2 shows a schematic representation of the electrically operated aerosol-generating system 10 of FIGS. 1A and 1B. The smartphone comprises a user interface 30 comprising a touch sensitive LCD display. The touch sensitive LCD display is capable of displaying various software applications, including a software application 32 relating to the operation of the aerosol-generating assembly 16. The software application 32 is stored on a data storage device 34 within the smartphone and is executed by a microprocessor 36. The various components within the smartphone are powered by an internal battery 38 that can be recharged via the micro-USB port 18 using a conventional charger 19.

The battery unit 14 comprises a rechargeable battery 40 and control electronics 42. The rechargeable battery 40 can be recharged by plugging a suitable charger into the micro-USB port 22 on the battery unit 14. Additionally, or alternatively, the rechargeable battery 40 can be recharged using the battery 38 within the smartphone.

The aerosol-generating assembly 16 comprises a data storage device 50, an electric heater 52 and an aerosol-forming substrate 54 in thermal contact with the electric heater 52. Each of the micro-USB ports and plugs 18, 20, 22, 24 supports the transfer of electrical power and the two-way transfer of data.

In use, the microprocessor 36 in the smartphone communicates via the micro-USB port 18 and the micro-USB plug 20 with the control electronics 42 in the battery unit to control the supply of an electrical current to the electric heater 52 via the micro-USB port 22 and the micro-USB plug 24. Electrical current can be supplied to the electric heater 52 from the battery 40 in the battery unit 14, directly from the battery 38 within the smartphone by bypassing the battery 40 in the battery unit 14, or both. The microprocessor 36 controls the supply of electrical current based on a predetermined heating profile that is appropriate for the particular aerosol-forming substrate 54 in the aerosol-generating assembly 16. The heating profile is stored on the data storage device 50 in the aerosol-generating assembly 16 and retrieved by the microprocessor 36.

The touch-sensitive LCD display can receive user input to allow a user to interact with the software application 32 relating to the operation of the aerosol-generating assembly 16. The software application 32 may permit the user to modify, either temporarily or permanently, parameters of the heating profile loaded from the data storage device 50 in the assembly 16. The software application 32 may also display on the LCD display various parameters relating to the operation of the assembly 16, such as the type of assembly and the number of puffs remaining.

The software application 32 may establish a remote connection with a remote server 60 to receive remote data from the server 60. For example, the server 60 may provide an updated heating profile for the aerosol-generating assembly 16. In this case, the updated heating profile may be transferred from the remote server 60 to the data storage device 50 in the aerosol-generating assembly 16 via the smartphone.

Figure 3:
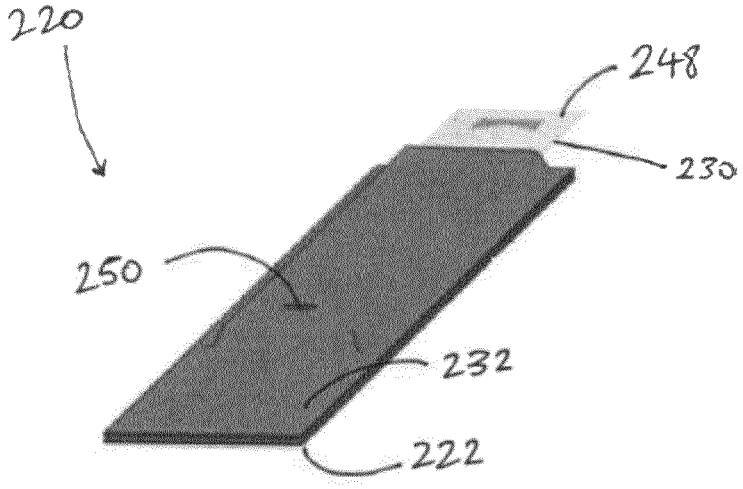
FIGS. 3 and 4 show an embodiment of an aerosol-forming substrate and heater assembly for use in an aerosol-generating assembly in accordance with the present invention, where
Figure 4:
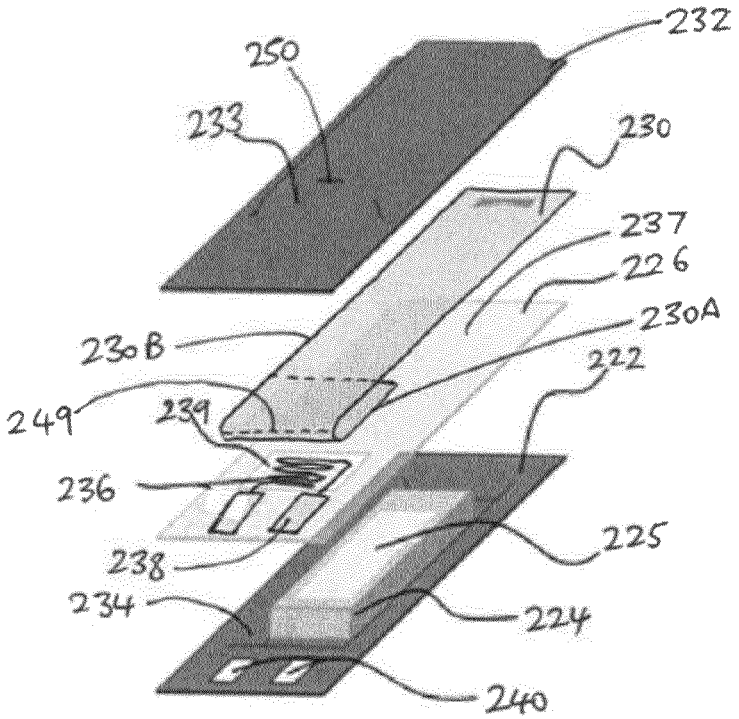

FIGS. 3 and 4 show an embodiment of an aerosol-forming substrate and heater assembly 220 for use in an aerosol-generating assembly according to the present invention. The assembly 220 has a generally rectangular cross-section, although it could be any other suitable flat shape. The assembly comprises a base layer 222, an aerosol-forming substrate 224 arranged on the base layer 222, a heater 226 positioned over the aerosol-forming substrate 224, a protective foil 230 over the heater 226, and a top cover 232 fixed to the base layer 222 and over the protective foil 230. The aerosol-forming substrate 224, the heater 226 and the protective foil 230 are all substantially flat and substantially parallel to each other. The contact surfaces between any two of the base layer 222, the aerosol-forming substrate 224, the heater 226 the protective foil 230, and the top cover 232 are substantially planar and substantially parallel with each other.

The base layer 222 is formed from a substantially planar sheet with a downwardly extending blister defining a cavity 234 on its top surface in which the aerosol-forming substrate 224 is held. The aerosol-forming substrate 224 comprises a liquid nicotine source. In this example, the aerosol-forming substrate 224 comprises a liquid nicotine source absorbed in a substantially flat rectangular block of a porous carrier material. A capillary patch 225 is provided on the top surface of the carrier material to assist with drawing the liquid substrate to the top surface of the carrier material for evaporation.

The heater 226 comprises a heating element 236 connected to electrical contacts 238. In this example, the heating element 236 and electrical contacts 238 are integral and the heater 226 is formed by disposing heating element 236 and electrical contacts 238 on an electrically insulating substrate foil 237 such that the heating element 236 extends across an opening 239 formed in the electrically insulating substrate foil 237. In use, aerosol released by the aerosol-forming substrate 224 passes through the opening 239 in the electrically insulating substrate foil 237 and through the heating element 236. The electrically insulating substrate foil 237 is sized to fit over the cavity 234 in the base layer 222 and helps to keep the aerosol-forming substrate 224 in position on the base layer 222. In this example, the electrically insulating substrate foil 237 extends laterally beyond the cavity 234 and has substantially the same width and length as the base layer 222 so the edges of the cover layer 228 and the base layer 222 are generally aligned. The base layer 222 has two contact apertures 240 at its distal end into which the electrical contacts 238 extend. The electric contacts 238 are accessible from outside of the assembly through the contact apertures 240.

The protective foil 230 is removably attached to the top of the heater 226 and over the opening 239 in the electrically insulating substrate foil 237 to seal the aerosol-forming substrate 224 within the assembly 220. The protective foil 230 comprises a substantially impermeable sheet that is welded to the heater 226 but which can be easily peeled off. The sheet is welded to the heater 226 along a continuous sealing line formed of two continuous weld lines arranged side by side. The protective foil 230 acts to prevent substantial loss of volatile compounds from the aerosol-forming substrate 224 prior to use of the aerosol-generating assembly. A tab 248 is provided at the free end of the protective foil 230 to allow a user to grasp the protective foil 230 to peel it off from over the opening 239. The tab 248 is formed by an extension of the protective foil 230 and extends beyond the edge of the top cover 232. To facilitate removal, the protective foil 230 is folded over itself at a transverse fold line 249 such that the protective foil 230 is divided into a first portion 230A, which is attached to the heater 226 by the continuous sealing line, and a second portion 230B, which extends longitudinally from the fold line 249 to the tab 248. The section portion 230B lies flat against the first portion 230A so that the first and second portions 230A, 230B are substantially co-planar. With this arrangement, the protective foil 230 can be removed by pulling the tab 248 longitudinally to peel the first portion 230A away from the heater 226 at the fold line 249. The aerosol-generating assembly may comprise a main body defining a cavity in which the assembly is housed. In this case, the main body may comprise a slot through which the pulling tab 248 at least partially extends to allow removal and extraction of the protective foil 230 through the slot. Alternatively, the assembly may be removably received within the main body so that the protective foil 230 can be removed prior to inserting the assembly into the main body.

It will be apparent to one of ordinary skill in the art that, although welding is described as the method to secure the removable protective foil 230 to the heater 226, other methods familiar to those in the art may also be used including, but not limited to, heat sealing or gluing, provided the protective foil 230 may easily be removed by a consumer.

The top cover 232 is formed from a substantially planar sheet with an upwardly extending blister 233 on its top surface. The top cover 232 includes an air inlet 250 towards the distal end of the blister and an air outlet (not shown) at its proximal end. The air inlet 250 and the air outlet are connected by an air flow channel defined by the blister 233. During use, the protective foil 230 is removed by pulling the tab 248 in a longitudinal direction and away from the assembly 220. Once the protective foil 230 has been removed, the aerosol-forming substrate 224 is in fluid communication with the air flow channel via the opening 239 in the electrical insulating substrate 237. Electrical power is then provided to the heater 226 of the assembly to release aerosol from the aerosol-forming substrate. When a user sucks or puffs on the mouthpiece portion of the aerosol-generating assembly, air is drawn from the air inlets in the mouthpiece, into the air inlet 250 of the top cover and through the air flow channel in the top cover 232, where it is mixed with the aerosol. The air and aerosol mixture is then drawn through the air outlet of the assembly 220 to the outlet of the mouthpiece.

The invention claimed is:

1. An electrically operated aerosol-generating system, comprising:

an aerosol-generating assembly comprising an aerosol-forming substrate, at least one electric heater configured to heat the aerosol-forming substrate, a first data storage device, and a first electrical connector; and a multi-purpose computing device comprising a supply of electrical energy, a multi-purpose user interface, at least one user input device, a second data storage device, a plurality of software applications installed on the second data storage device, a microprocessor, and a second electrical connector, wherein the first and second electrical connectors are configured to enable two-way data transfer between the multi-purpose computing device and the aerosol-generating assembly, and to enable a supply of electrical current from the supply of electrical energy to the at least one electric heater, wherein at least one of the software applications is configured to control a supply of electrical current to the at least one electric heater in accordance with a predetermined heating profile stored on the first data storage device, wherein the microprocessor is configured to retrieve the predetermined heating profile from the first data storage device, query a remote server to determine whether an updated heating profile is available for the aerosol-generating assembly, and when the updated heating profile is available, to retrieve the updated heating profile from the remote server and store the updated heating profile on the first data storage device, wherein the first electrical connector is a plug and the second electrical connector is a port, the first and the second electrical connectors being configured for direct connection to each other, and wherein the aerosol-forming substrate is substantially flat.

2. The electrically operated aerosol-generating system according to claim 1, further comprising a battery unit comprising:

a battery;

a third electrical connector configured for connection to the first electrical connector on the aerosol-generating assembly; and a fourth electrical connector configured for connection to the second electrical connector on the multi-purpose computing device, wherein the first, the second, the third, and the fourth electrical connectors are configured to enable the two-way data transfer between the multi-purpose computing device and the aerosol-generating assembly, wherein the first, the second, the third, and the fourth electrical connectors are configured to enable the supply of electrical current from the supply of electrical energy to the aerosol-generating assembly, wherein the first and the third electrical connectors are configured to enable a supply of electrical current from the battery to the aerosol-generating assembly, and wherein the at least one software application is configured to control the supply of electrical current to the at least one electric heater from at least one of the supply of electrical energy and the battery in accordance with the predetermined heating profile stored on at least one of the first and second data storage devices.

3. The electrically operated aerosol-generating system according to claim 2, wherein the battery is a rechargeable battery, and wherein the second and the fourth electrical connectors are configured to enable a supply of electrical current from the supply of electrical energy to the rechargeable battery to recharge the battery.

4. The electrically operated aerosol-generating system according to claim 1, wherein the at least one software application is further configured to receive user input from the at least one user input device to enable a user to modify the predetermined heating profile.

5. The electrically operated aerosol-generating system according to claim 1, wherein the at least one software application is further configured to receive remote data from a remote source and transfer the remote data to the first data storage device.

6. The electrically operated aerosol-generating system according to claim 5, wherein the at least one software application is further configured to receive a new heating profile from the remote source and transfer the new heating profile to the first data storage device.

7. The electrically operated aerosol-generating system according to claim 5, wherein the remote source is a remote data server and wherein the at least one software application is configured to establish a remote data connection with the remote data server to receive the remote data.

8. The electrically operated aerosol-generating system according to claim 1, wherein the multi-purpose user interface comprises a touch-sensitive display, and wherein the at least one user input device comprises the touch-sensitive display.

9. The electrically operated aerosol-generating system according to claim 1, wherein the aerosol-generating assembly further comprises:

a main body defining a cavity in which the aerosol-forming substrate, the at least one electric heater, and the first data storage device are received; and a mouthpiece provided at a first end of the main body, wherein the first electrical connector is provided at a second end of the main body opposite the first end.

10. The electrically operated aerosol-generating system according to claim 1, wherein the first electrical connector comprises a standardized electrical connection.

11. The electrically operated aerosol-generating system according to claim 10, wherein the standardized electrical connection comprises one of a universal serial bus connection and a secure-digital connection.

12. The electrically operated aerosol-generating system according to claim 1, wherein the multi-purpose computing device comprises one of a personal computer, a laptop, a netbook, a tablet computer, or a smartphone.

* * * * *